US005848879A

United States Patent [19]

Hansson

[11] Patent Number: 5,848,879

[45] Date of Patent: Dec. 15, 1998

[54] CYLINDER LINING FOR HYDRAULIC PUMP

[75] Inventor: Mikael Hansson, Orsa, Sweden

[73] Assignee: Pressmaster Tool AB, Alvdalen, Sweden

[21] Appl. No.: 640,871

[22] PCT Filed: Oct. 27, 1994

[86] PCT No.: PCT/SE94/01012

§ 371 Date: May 1, 1996

§ 102(e) Date: May 1, 1996

[87] PCT Pub. No.: WO95/14170

PCT Pub. Date: May 26, 1995

[30] Foreign Application Priority Data

Nov. 18, 1993 [SE] Sweden ..... 9303823

[51] Int. Cl.[6] ..... F04B 7/00

[52] U.S. Cl. ..... 417/521; 417/273; 92/171.1

[58] Field of Search ..... 417/273, 521; 92/171.1; 277/53

[56] References Cited

U.S. PATENT DOCUMENTS

| | | | |
|---|---|---|---|
| 1,061,700 | 5/1913 | Syeinbecker | 417/470 |
| 1,964,679 | 6/1934 | Springfield | 417/273 X |
| 2,393,175 | 1/1946 | Laskey | 417/273 |
| 2,945,444 | 7/1960 | Lessner | 92/171.1 X |
| 3,474,709 | 10/1969 | Hamlin | 92/171.1 X |
| 4,474,541 | 10/1984 | Siewert | 92/171.1 |
| 4,874,297 | 10/1989 | Collins et al. | 417/273 X |
| 4,889,039 | 12/1989 | Miller | 277/53 X |
| 4,968,220 | 11/1990 | Filippi et al. | 417/273 |
| 5,107,680 | 4/1992 | Hojnacki et al. | 92/171.1 |

FOREIGN PATENT DOCUMENTS

| | | |
|---|---|---|
| 2 317 078 | 10/1974 | Germany . |
| 1 302 163 | 1/1973 | United Kingdom . |

*Primary Examiner*—Charles G. Freay

*Attorney, Agent, or Firm*—Jacobson, Price, Holman & Stern, PLLC.

[57] ABSTRACT

A hydraulic pump includes a pump housing block, a rotary drive shaft and plural pumping assemblies extending radially from the rotary drive shaft. Each pumping assembly includes a reciprocating piston, a cylinder lining, and a piston return spring mounted between the piston and the lining. The cylinder linings are inserted into the pump block from the outside and a detachable latching device secures the linings to the block. The cylinder lining, the piston and the piston return spring can be easily removed and replaced after the latching device, for instance a locking ring, has been removed.

9 Claims, 1 Drawing Sheet

CYLINDER LINING FOR HYDRAULIC PUMP

BACKGROUND OF THE INVENTION

1. Field of the Invention

The present invention relates to a hydraulic pump of the kind which includes a pump housing block which is provided with means for driving a piston axially forwards and backwards, a piston-receiving cylindrical bore, inlet and outlet passageways which connect with the cylinder and through which hydraulic fluid is drawn by suction into the cylinder and discharged therefrom respectively, wherein each of the passageways includes a respective check valve which determines the direction in which hydraulic medium will flow in respective passageways.

2. Description of the Related Art

Hydraulic piston pumps are subjected to wear on surfaces which move relative to one another, particularly on the piston and the surfaces of the cylinder bore in which it moves. Such wear is accentuated when the components move at a relatively high speed, and when the pump works at high pressures and is kept working for long periods of time.

The operational efficiency of hydraulic pumps which are subjected to such heavy loads as those inferred above will be gradually impaired or the pump will malfunction, which means, in turn, that the pump must be replaced or repaired. However, the pump normally comprises only one part of a working machine, which must be taken out of operation while the faulty hydraulic pump is being dealt with.

In the case of known radial piston pumps, which are used as hydraulic pumps, a number of pump devices are disposed radially around a pump housing block in a star-like configuration, said block including a drive shaft which is common to the pump devices and which includes an eccentric which coacts with said devices. When such a radial piston pump is in need of repair, it is necessary for an operator or fitter to dismantle each of the pump devices from the block, wherein bolts must be loosened, replaced and re-tightened, and a relatively large working space is required around the pump itself to enable the replacement of pump devices in the pump housing block of the machine in which the hydraulic pump is fitted.

Prior publication DE-A-2,317,089 discloses a paint spray which includes a paint conduit having incorporated therein at least one check valve, to form a paint pump chamber of which one wall consists of a diaphragm which is driven reciprocatingly by pulsating hydraulic pressure generated by a piston which is reciprocatingly movable in a cylinder lining that can be fitted loosely in a bore. It is necessary to dismantle the paint pump chamber before access can be had to the cylinder lining. The bore which receives the lining opens into the hydraulic reservoir at a level beneath the surface of the hydraulic fluid.

Prior publications GB-A-1,302,163 and U.S. Pat. No. 4,968,220 relate to hydraulic pumps where the pump must be dismantled before the cylinder lining/piston can be changed, this work being relatively complicated.

Consequently, no hydraulic pump can be repaired on site in practice and it is therefore necessary in practice to take the whole of the assembly which includes the hydraulic pump to a workshop, in order to repair the pump.

SUMMARY OF THE INVENTION

Accordingly, one object of the present invention is to provide a hydraulic pump construction which will enable the pump to be repaired quickly and simply within the confines of a relatively small space and with the use of a relatively small number of tools.

This object is achieved with the inventive hydraulic pump.

One essential feature of the invention is that the pump housing block has a cylinder which opens out onto the outside of the block, and that a cylinder lining can be inserted loosely into the cylinder and supported against the cylinder wall. A releasable latching device, such as a groove-seated locking ring, is fitted to prevent the lining moving out of the cylinder in a direction towards the outer side of the block. The lining has at least one opening which passes through its cylinder wall and establishes communication between the hollow interior of the cylinder lining and hydraulic fluid passageways in the block. Disposed circumferentially around the outer surface of the lining are labyrinth seals which define a circumferentially extending passageway into which the passageways in the pump housing block discharge and into which the opening or openings in the lining also discharges or discharge. This enables the cylinder to have a circular-cylindrical shape and also enables the lining to be circular-cylindrical in shape and to adopt any position of rotation within the cylinder. The groove which receives the aforesaid locking ring is located at the outer end of the cylinder, wherein the locking ring may support directly against the outer end of the lining. The actual lining is cup-shaped and includes external flanges or fins which, as mentioned, seal against the cylindrical wall so as to establish a seal against the flow of hydraulic fluid axially in the cylinder, between the lining and the cylinder wall.

The outer end of the cylinder lining may include a somewhat enlarged flange which is received on a corresponding shoulder or ledge in the outer end-region of the cylinder bore, so as to define a definite axial position for the cylinder lining radially inwards, while the groove-seated locking ring defines the position of the lining radially outwards.

The piston drive means may comprise a rotatable shaft having an eccentric which acts on the radially inner end of the piston.

The inventive hydraulic pump may advantageously include at least two piston/cylinder assemblies which are driven by a common drive means and which are mutually spaced circumferentially around the rotational axis of the drive means.

The radially inner end of the piston may include a support f or a return spring which acts against a support surface on the lining, wherein the piston support and the spring are both dimensioned to enable them to be removed through the cylinder bore or barrel.

This will enable an insert assembly comprised of the cylinder lining, the return spring and the piston to be removed readily from the pump as soon as the locking ring has been dismantled in a conventional way, and quickly replaced with a new, corresponding assembly which is locked in place with the aid of the groove-seated locking ring.

The invention will now be described in more detail with reference to an exemplifying embodiment thereof and also with reference to the accompanying drawing, in which

DESCRIPTION OF THE PREFERRED EMBODIMENTS

Figure 1:
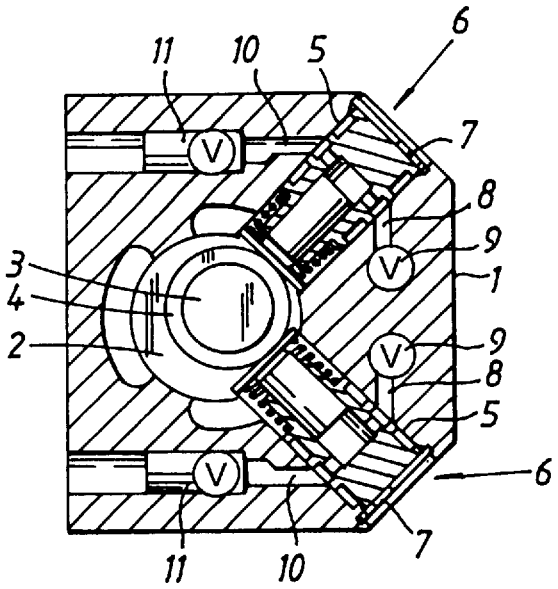
FIG. 1 is a schematic sectional view of an inventive hydraulic pump.
Figure 2:
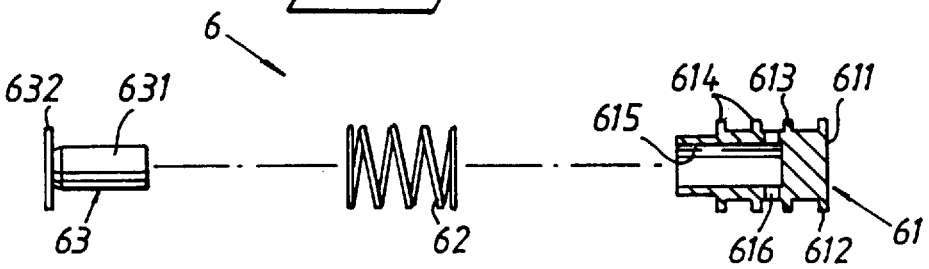
FIG. 2 is an expanded illustration of a cylinder lining and associated cylinder and spring, included in the pump shown in FIG. 1.
Figure 3:
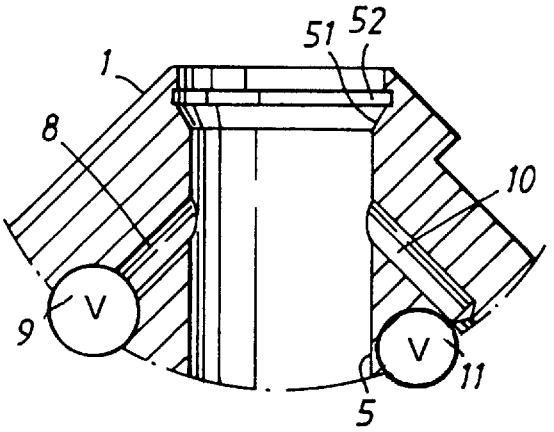
FIG. 3 is an enlarged view of a cylinder mounted in the pump housing block and receiving the assembly shown in FIG. 2.

FIG. 1 illustrates a pump housing block 1 having a rotatable shaft 2 which is rotated by means of a motor, not shown. The shaft 2 is provided with an eccentric 3 which is embraced by a bearing 4. Two cylindrical bores 5 are disposed radially to the shaft 2 and extend out through the outside of the block 1. The cylinder 5 includes a pump means 6 comprising a cylinder lining 61 which receives a pump piston 63, wherein a spring 62 is mounted between the lining 61 and the piston 63 and functions to return the piston 63 towards the eccentric 3 on bearing 4. The lining 61 includes an end-flange 611 which is received in a corresponding recess 51 (see FIG. 3) and locked with a locking ring (not shown) seated in a recess 52 (FIG. 3) intended therefor. The piston 63 has a piston part 631 which fits in the lining barrel 615, and a support plate 632 which alternates with the bearing 4. The lining is provided on its bottom part with a plurality of openings 616 which penetrate the wall of the lining, and sealing flanges 612–614 which define a labyrinth seal are mounted on the outside of the lining on both sides of the axial position of the openings 616.

An inlet passageway 8 which includes a check valve 9 opens out into the cylinder wall 5 at the location of the lining opening 616, and an outlet passageway 10 which includes a check valve 11 also opens out into the cylinder wall 5 at an axial position which corresponds to the location of the opening 616 in the lining 61. The passageways 8 for the two pump devices can be supplied with hydraulic medium from a common source, and pressure lines 10 from the two pump devices are conveniently combined to a common pressure channel.

The whole of the pump device 6 can be removed by dismantling the locking ring 7 from its groove 52, and then replaced with a new pump device, after which the locking ring 7 is refitted. The ease with which the pumping devices can be removed and replaced enables repair work to be carried out by less qualified personnel in the proximity of the hydraulic pump when so required, even on site and in the shortest time.

The cylinder bores open out onto the outside of the block at easily reached locations, wherein the locations may also be exposed so as to be readily seen for inspection purposes and when changing pump assemblies (cylinder lining, piston and spring) and so that any leakage of hydraulic fluid that might occur can be readily seen in the inspection, such leakage often indicating the need to change a pump assembly. The bores are also positioned to enable the pump inserts or assemblies to be withdrawn and inserted with no difficulty. Furthermore, the pump is oriented and designed so that no appreciable amounts of hydraulic fluid will run-out via the lining-receiving bore in the block when changing a pump insert, either from the pump housing chamber which contains the shaft 2 or through any of the inlet and outlet passageways 8, 10. The inventive hydraulic pump is normally contained in a protective casing, which can be easily removed to expose the actual hydraulic pump, i.e. the pump housing block.

A pump insert can be removed easily, by dismantling the latching means which is located in an accessible position in the outermost part of the cylinder bore. In addition to removing or opening the pump housing casing, all that is needed is to remove a locking ring from its groove in the outer end of the bore in order to be able to withdraw the pump assembly and replace this assembly with another which, after being inserted, is locked in place by means of the locking ring.

It will be obvious to the skilled person that the locking ring and its associated groove in the peripheral surface of the bore can be replaced with some other readily removable latching arrangement of a known kind which, when removed, will immediately enable a pump assembly to be changed.

I claim:

1. A hydraulic pump, comprising a pump housing block, means for driving at least one piston axially backwards and forwards, a cylinder bore which receives said piston and which is formed in said pump housing block, inlet and outlet passageways which connect with a wall of said cylinder bore and are adapted respectively to feed-in and discharge a hydraulic fluid, said passageways provided with respective check valves which determine the direction in which said hydraulic fluid will flow in said passageways, a cylinder lining having a generally annular wall which coacts with said piston removably inserted into and supported against the wall of said cylinder bore to screen said bore, said cylinder lining including at least one opening through its annular wall such that said opening establishes fluid communication between a hollow interior of said cylinder lining and said passageways in said block, said lining, said piston, and a spring acting therebetween form an exchangeable insert assembly, a detachable locking ring located outside said lining in a working direction of said piston and which locks said insert assembly in said cylinder bore and opens out on an exterior of said block to enable said insert assembly to be readily removed and replaced after releasing said locking ring, said lining having disposed peripherally around its outer surface axially spaced flanges which define a labyrinth seal with respect to a fluid distribution channel defined between said flanges, and said opening in said lining opens out into said fluid distribution channel.

2. A hydraulic pump comprising a pump housing block;

at least one cylinder bore formed in said pump housing block;

a piston received in said cylinder bore; a structure for driving said piston axially backwards and forwards; an inlet and outlet passageway that connects with an interior of said cylinder bore and which includes a check valve to direct a hydraulic medium respectively into and out of said cylinder bore; a removable cylinder lining inserted into said cylinder bore co-acting with said piston which includes at least one opening through an annular wall thereof and also includes peripherally disposed axially spaced flanges on its exterior surface that form a labyrinth seal with respect to a fluid distribution channel formed between said flanges; said fluid distribution channel establishing fluid communication between a hollow interior of said lining and said inlet and outlet passageways; said lining, said piston, and a spring acting therebetween forming an exchangeable removable insert assembly; and a latch which locks said insert assembly in the cylinder bore.

3. A hydraulic pump as recited in claim 2, wherein said cylinder bore opens outwardly to an exterior of said block to enable ready removal and replacement of said insert assembly after releasing of said latch.

4. A hydraulic pump as recited in claim 3, wherein said latch includes a locking ring which seats in a groove in said cylinder bore to support against and lock said cylinder lining in said bore.

5. A hydraulic pump as recited in claim 4, wherein said groove is positioned proximate to where said cylinder bore opens outwardly to the exterior of said block.

6. A hydraulic pump as recited in claim 2, wherein said spring is a pressure spring located between a shoulder on said cylinder lining and a support on a distal end of said piston located inwardly in relation to the exterior of said block.

7. A hydraulic pump as recited in claim 6, wherein the shoulder on said lining is positioned on the exterior surface of said lining and said spring acts about the exterior surface of said lining between said shoulder and said support.

8. A hydraulic pump as recited in claim 2, wherein said structure for driving said piston includes a drive shaft having a geometric axis that intersects with and is perpendicular to a longitudinal axis of said lining and has an eccentric that drives said piston in said cylinder bore.

9. A hydraulic pump as recited in claim 2, wherein at least four peripherally disposed axially spaced flanges are included on the exterior surface of the cylinder lining to form said labyrinth seal with said at least one opening positioned between two interior spaced flanges.

* * * * *